US006832591B2

(12) United States Patent
Hogins

(10) Patent No.: US 6,832,591 B2
(45) Date of Patent: Dec. 21, 2004

(54) ENGINE MANIFOLD AND ADAPTOR APPARATUS

(75) Inventor: Jon B. Hogins, McPherson, KS (US)

(73) Assignee: National Automotive Manufacturing, Inc., Morton Grove, IL (US)

( * ) Notice: Subject to any disclaimer, the term of this patent is extended or adjusted under 35 U.S.C. 154(b) by 0 days.

(21) Appl. No.: 10/376,649

(22) Filed: Mar. 3, 2003

(65) Prior Publication Data

US 2004/0173177 A1 Sep. 9, 2004

(51) Int. Cl.[7] ..... F02F 7/00
(52) U.S. Cl. ..... 123/195 A; 123/198 R
(58) Field of Search ..... 123/195 A, 198 R

(56) References Cited

U.S. PATENT DOCUMENTS 3,730,147 A * 5/1973 Buchwald ..... 123/41.44
4,633,828 A 1/1987 Steele
4,697,782 A 10/1987 Ban
5,203,293 A 4/1993 Shintani et al.
5,938,169 A * 8/1999 Ogawa et al. ..... 248/674

* cited by examiner

*Primary Examiner*—Thomas Denion
*Assistant Examiner*—Zelalem Eshete
(74) *Attorney, Agent, or Firm*—Knechtel, Demeur & Samlan

(57) ABSTRACT

A new engine manifold and adaptor that replaces two preexisting manifolds and accommodates the mounting of auxiliary devices such as an alternator or generator to the manifold and engine cylinder head. The manifold consists of an arm and an end having manifold mounting holes. The adaptor consists of a base and a tiered portion having receiving holes and securing holes. The auxiliary device provides securing holes. The engine cylinder head provides engine cylinder head receiving holes. A fastener is inserted through the securing holes in the accessory and into the receiving holes in the adaptor for attaching the accessory to the adaptor. Likewise, a fastener is inserted through the securing holes in the adaptor, through the mounting holes in the manifold, and directly into the engine cylinder head receiving holes for securing the adaptor to the manifold and the engine cylinder head. In this manner, the adaptor is secured to the manifold and the engine cylinder head thereby attaching the auxiliary device to the engine cylinder head.

14 Claims, 2 Drawing Sheets

ENGINE MANIFOLD AND ADAPTOR APPARATUS

I. FIELD OF THE INVENTION

The present invention relates to engine manifolds and adaptor assemblies and, more particularly, to a new engine manifold and adaptor that enables the coupling of auxiliary devices to an engine cylinder head.

II. DESCRIPTION OF THE PRIOR ART

During the years 1960 to 1970, General Motors manufactured an engine manifold as illustrated in FIG. 1. The engine manifold 10 had an end flange 12. The end flange 12 had two bolt receiving holes 14 and 16 through which screws passed to attach the manifold 10 to an engine cylinder head (not illustrated). The end flange 12 also had two additional fastener holes 18 and 20 which were threaded to receive a mounting bracket (not illustrated) to which an accessory such as a generator or alternator was attached.

A problem with this engine manifold is that the integrally formed end flange 12 is susceptible to breaking or experiencing failures that render the engine manifold unusable. As a result, the accessory (i.e., generator or alternator) could no longer be fastened to the end flange 12 of the manifold 10 and there was no other means for attaching these auxiliary devices to the engine cylinder head. Since the end flange 12 could not be replaced as a separate part to the manifold 10, the entire engine manifold 10 had to be replaced. Such a predicament is an unnecessary waste considering that the remainder of the engine manifold 10 remained in acceptable working order with respect to the engine and engine cylinder head. Additionally, as this manifold is very old, the problem is further exacerbated as the replacements of this old manifold are very difficult to locate.

In the years 1969 to 1972, General Motors manufactured a similar manifold without the end flange. As a result, the alternator or generator did not attach to the manifold but rather had to be attached to other portions of the engine cylinder head.

The use of two different manifolds also presents a problem for auto parts dealers. They were required to maintain an inventory of both manifolds. Furthermore, manufacturers of the replacement manifolds had to maintain tooling for both manifolds.

In the past, several devices have been patented relating to the attachment of auxiliary devices to an engine. However, none of these patented devices solve the problem currently presented by today's engine manifolds. For example, U.S. Pat. No. 4,633,828 illustrates an adjustable polar point mounting bracket with two curved slots at each end. An extension has two legs of unequal length attached to the polar bracket. The accessory is connected to the apex or polar point of the extension to allow greater flexibility in the mounting position of the accessory.

U.S. Pat. No. 4,697,782 illustrates a mounting bracket or mounting structure for mounting various auxiliary items such as an alternator or compressor onto the engine. The bracket attaches to the engine. The auxiliary device is attached to the bracket. Other auxiliary devices are attached to the first device by means of additional brackets.

U.S. Pat. No. 5,203,293 discloses an auxiliary mounting structure, or mounting bracket, that is designed for attaching an auxiliary mechanism, such as a compressor or alternator, to the engine. The mounting structure is designed with a mounting portion so that it has high bearing rigidity in the longitudinal direction and low bearing rigidity in the vertical direction. This allows the auxiliary mechanism to easily vibrate in the vertical direction which acts as a damper to the normal engine vibration.

Thus, there is a need and there has never been disclosed a new manifold and unique adaptor that replaces two existing manifolds and obviates the problems presented by these manifolds in connecting auxiliary devices such as an alternator or generator to an engine manifold and cylinder head.

III. OBJECTS OF THE INVENTION

It is the primary object of the present invention to provide a new manifold designed to receive adaptor assemblies for connecting auxiliary devices, such as alternators and generators, to an engine cylinder head. A related object of the present invention is to provide a unique adaptor that accommodates the new manifold design and provides the means to attach the auxiliary device to the manifold.

Another related object of the present invention is to provide a new manifold that is designed to replace either of two existing manifolds. A related object of the present invention is to lessen the burden of locating an identical old manifold containing the same inherent problems to replace its broken counterpart. An advantage of the new manifold and adaptor is that it replaces two manifolds which reduces inventory requirements and manufacturing costs.

Still another object of the invention is to provide a new manifold and adaptor that is easy to use, eliminates unnecessary connections, and provides a more integral unit.

Other objects of the present invention will become more apparent to persons having ordinary skill in the art to which the present invention pertains from the following description taken in conjunction with the accompanying drawings.

IV. SUMMARY OF THE INVENTION

The present invention is a new manifold and unique adaptor for attaching an accessory such as an alternator or generator to the engine manifold and an engine cylinder head. The manifold consists of an arm and an end having several manifold mounting holes which align with receiving holes in the engine cylinder head. The adaptor consists of a base and a tiered member having a plurality of receiving holes and a plurality of securing holes. The accessory has a plurality of securing holes.

In use, the combination of the adaptor and manifold coact to connect the accessory to the engine cylinder head. The plurality of securing holes in the accessory align with the plurality of receiving holes in the adaptor. A fastening means is inserted through the plurality of securing holes in the accessory and into the plurality of receiving holes in the adaptor for attaching the accessory to the adaptor. Likewise, the plurality of securing holes in the adaptor are correspondingly aligned in parallel with the plurality of manifold mounting holes and the engine cylinder head receiving holes. A securing means is inserted through the plurality of securing holes in the adaptor, through the mounting holes in the manifold, and directly into the engine cylinder head receiving holes. In this manner, the adaptor is secured to the manifold and the engine cylinder head thereby attaching the accessory to the engine cylinder head.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
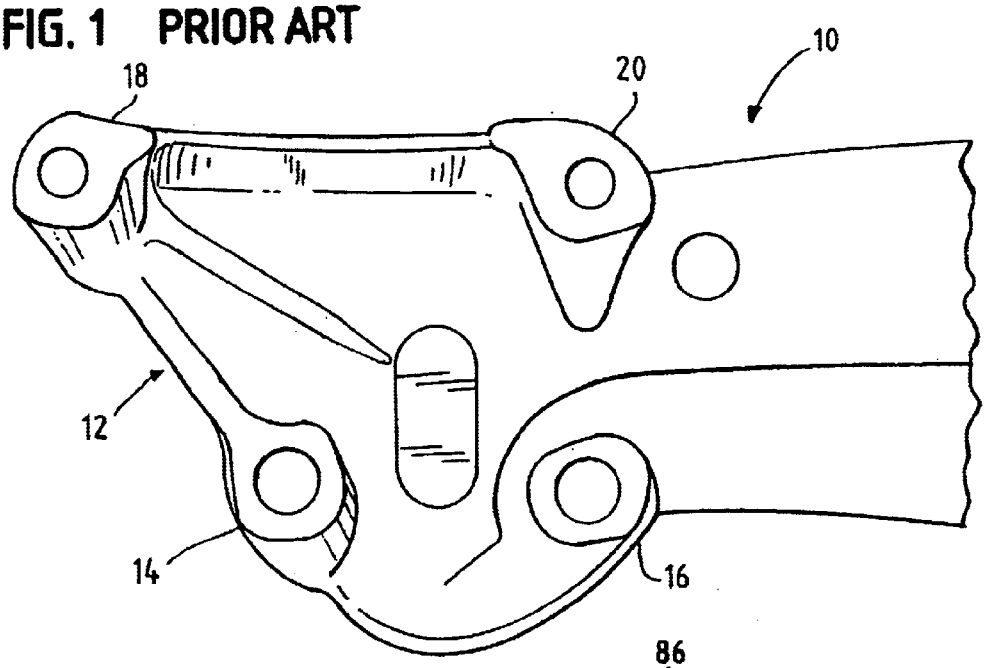
FIG. 1 PRIOR ART
FIG. 1 is a top view of a prior art engine manifold manufactured by General Motors illustrating the end flange for connection to the auxiliary devices.
Figure 2:
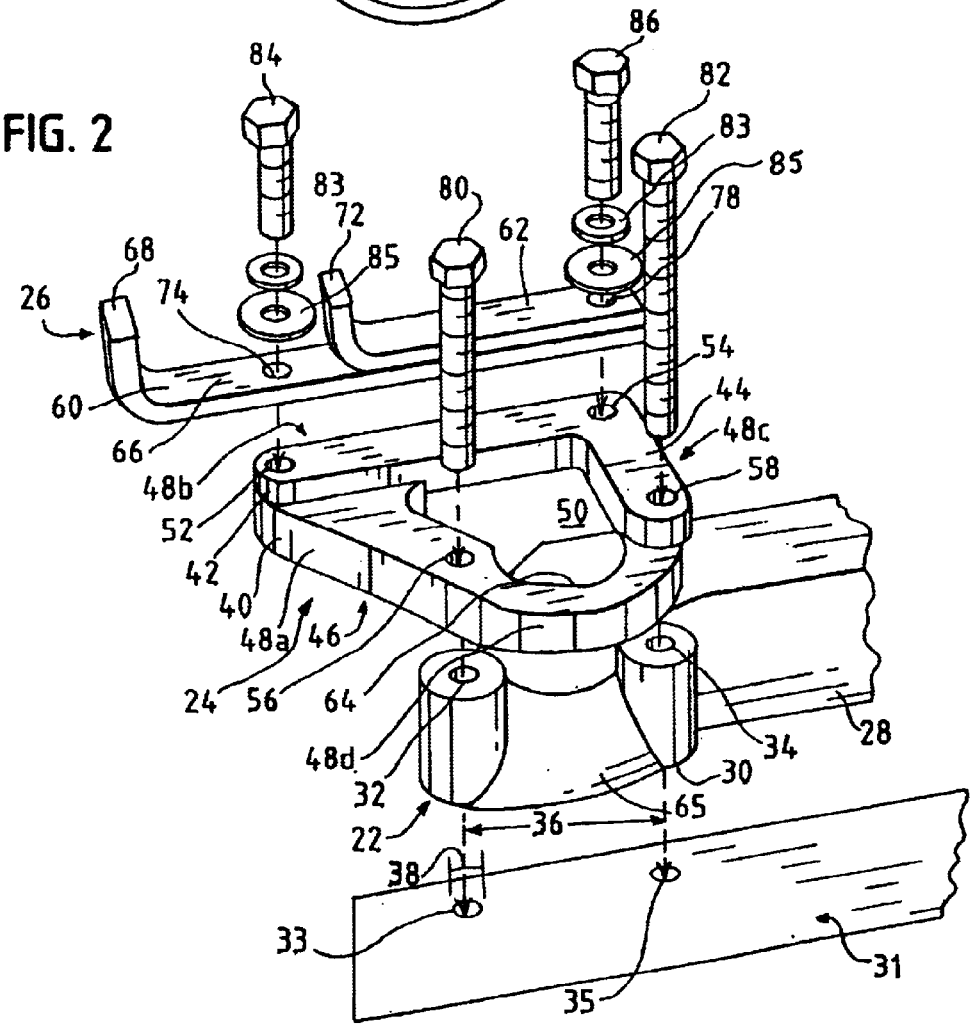
FIG. 2 is an exploded perspective view of Applicant's new manifold and adaptor for connecting auxiliary devices such as a generator to the engine cylinder head.

Turning to FIG. 2, there is illustrated a new engine manifold 22, an adaptor 24, and an F-Bracket 26. The engine manifold 22 has an arm 28 and an end 30. The arm 28 leads to the other portion of the manifold that also connects to an engine cylinder head 31. Applicant's invention relates to the end 30 of the manifold 22 and not the other portions of the manifold 22 which remain similar to the prior design. The end 30 has manifold mounting holes 32 and 34 separated by a distance 36. In the preferred embodiment, the manifold mounting holes 32 and 34 have smooth bores. Each manifold mounting hole 32 and 34 is also preferably identical and has a receiving hole diameter 38. The engine manifold 22 is made of a rigid material that can withstand the heat from the engine such as cast iron. Alternatively, the engine manifold 22 may be made of any other rigid material such as steel. The engine cylinder head 31 has engine cylinder head receiving holes 33 and 35 that are threaded.

The adaptor 24 consists of a base 40 and a tiered portion 42. The base 40 and the tiered portion 42 are integrally molded to form a continuous member with a top 44, a bottom 46, and sides 48*a–d*. The tiered portion 42, as discussed in further detail below, is positioned higher than the base 40 to account for the arm 28 having a height that is higher than the manifold mounting holes 32 and 34 on the end 30. Preferably, sides 48*b* and 48*c* form an L-shaped tiered portion 42 that has side 48*b* being perpendicular to side 48*c*. Located on the top 44 of the base 40 and tiered portion 42 are adaptor receiving holes 52 and 54 and adaptor securing holes 56 and 58. In the preferred embodiment, the adaptor receiving holes 52 and 54 are threaded and the adaptor securing holes 56 and 58 have a smooth bore through the entire adaptor 24. Situated in the center of the adaptor 24 is an opening 50. Within the opening 50 and opposite of side 48*b*, the base 40 forms an arc 64 that receives an arcuate portion 65 of the manifold which further assists in securing the adaptor 24 to the manifold 22 and prevents rotation of the adaptor 24 in relation to the manifold 22.

The F-Bracket 26 consists of an elongated L-bracket 60 and a short L-bracket 62. The elongated L-bracket 60 has a horizontal member 66 and a vertical member 68 and the short L-bracket 62 has a horizontal member 70 and a vertical member 72. The F-Bracket 26 has two F-bracket mounting holes 74 and 78. The F-Bracket 26 is formed by the short L-bracket 62 being placed on top of and aligned parallel to the L-bracket 60 such that the F-bracket mounting hole 78 of the short L-bracket 62 is correspondingly aligned with the F-bracket mounting hole 78 of the elongated L-bracket 60. In this manner, the vertical member 68 and the vertical member 72 remain in spaced parallel relationship so that the F-bracket mounting hole 74 of the elongated L-bracket 60 remains accessible.

In use, the engine manifold 22, the adaptor 24, and the F-Bracket 26 coact to connect an accessory to the engine cylinder head 31. In the preferred embodiment, the accessory is an alternator or generator. Alternatively, it is contemplated that any other type of accessory may be connected to the engine manifold 22 in the manner described herein.

If the prior art General Motors manifold 10 required replacement due to the end flange 12 of the manifold 10 breaking or the manifold 10 becoming ineffective from deterioration or otherwise, the manifold 10 would be replaced by Applicant's new engine manifold 22. The new manifold 22 is attached to the engine cylinder head 31 in the same manner as the original equipment manifolds. As such, the manifold mounting holes 32 and 34 of the new manifold 22 are correspondingly aligned in parallel with the engine cylinder head receiving holes 33 and 35, respectively, in the engine cylinder head 31.

As there exists no end flange 12 on Applicant's new engine manifold 22, Applicant's adaptor 24 is used and attached to the manifold 22. The base 40 of the adaptor 24 is placed firmly and aligned with the end 30 of the manifold 22. As the base 40 is being aligned with the end 30 of the manifold 22, the arc 64 and the tiered portion 42 are designed and situated to allow the base 40 to contact the end 30 without contacting the arm 28. In the preferred embodiment, the adaptor securing hole 56 of the adaptor 24 is correspondingly aligned in parallel with the manifold mounting hole 32 of the manifold 22 and the adaptor securing hole 58 of the adaptor 24 is correspondingly aligned in parallel with the manifold mounting hole 34 of the manifold 22.

The F-Bracket 26 is attached to the adaptor 24. In the preferred embodiment, the F-bracket mounting hole 74 of the elongated L-bracket 60 is correspondingly aligned in parallel with the adaptor receiving hole 52 on the adaptor 24 and the F-bracket mounting hole 78 of the elongated L-bracket 60 and short L-bracket 62 is correspondingly aligned with the adaptor receiving hole 54 on the adaptor 24. Also, side 48*b* of the tiered portion 42 becomes parallel to and flush with the corresponding sides of the elongated L-bracket 60 and the short L-bracket 62. Then, the accessory such as the alternator or generator (not illustrated) is attached to the vertical members 68 and 72 of the F-Bracket 26 by any conventional means.

Lastly, the engine manifold 22, the adaptor 24, and the F-bracket 26 are securely assembled together using screws or bolts 80, 82, 84, and 86. In the preferred embodiment, the screws are threaded. Screws 80 and 82 are inserted completely through the adaptor securing holes 56 and 58, respectively, completely through the manifold mounting holes 32 and 34, respectively, and directly into the engine cylinder head receiving holes 33 and 35. As the engine cylinder head receiving holes 33 and 35 are likewise threaded, the screws 80 and 82 are twisted clockwise, thereby, being tightly received by the engine cylinder head receiving holes 33 and 35. Due to the design and alignment of the new engine manifold 22 and adaptor 24, the manifold 22 and the adaptor 24 are securely affixed to the engine cylinder head with only two fastening means or screws. Alternatively, it is possible for the manifold 22 and the adaptor 24 to be securely affixed to the engine cylinder head with only one fastening means or screw.

Screws 84 and 86 are inserted completely through the F-bracket mounting holes 74 and 78 of the F-Bracket 26, respectively, and directly into the adaptor receiving holes 52 and 54, respectively. As the adaptor receiving holes 52 and 54 are likewise threaded, the screws 84 and 86 are twisted clockwise, thereby, being tightly received by the adaptor receiving holes 52 and 54 and securing the F-Bracket 26 to the adaptor 24. Local washers 83 and fender washers 85 may also be used along with the screws 84 and 86 in securing the F-Bracket 26 to the adaptor 24.

Figure 3:
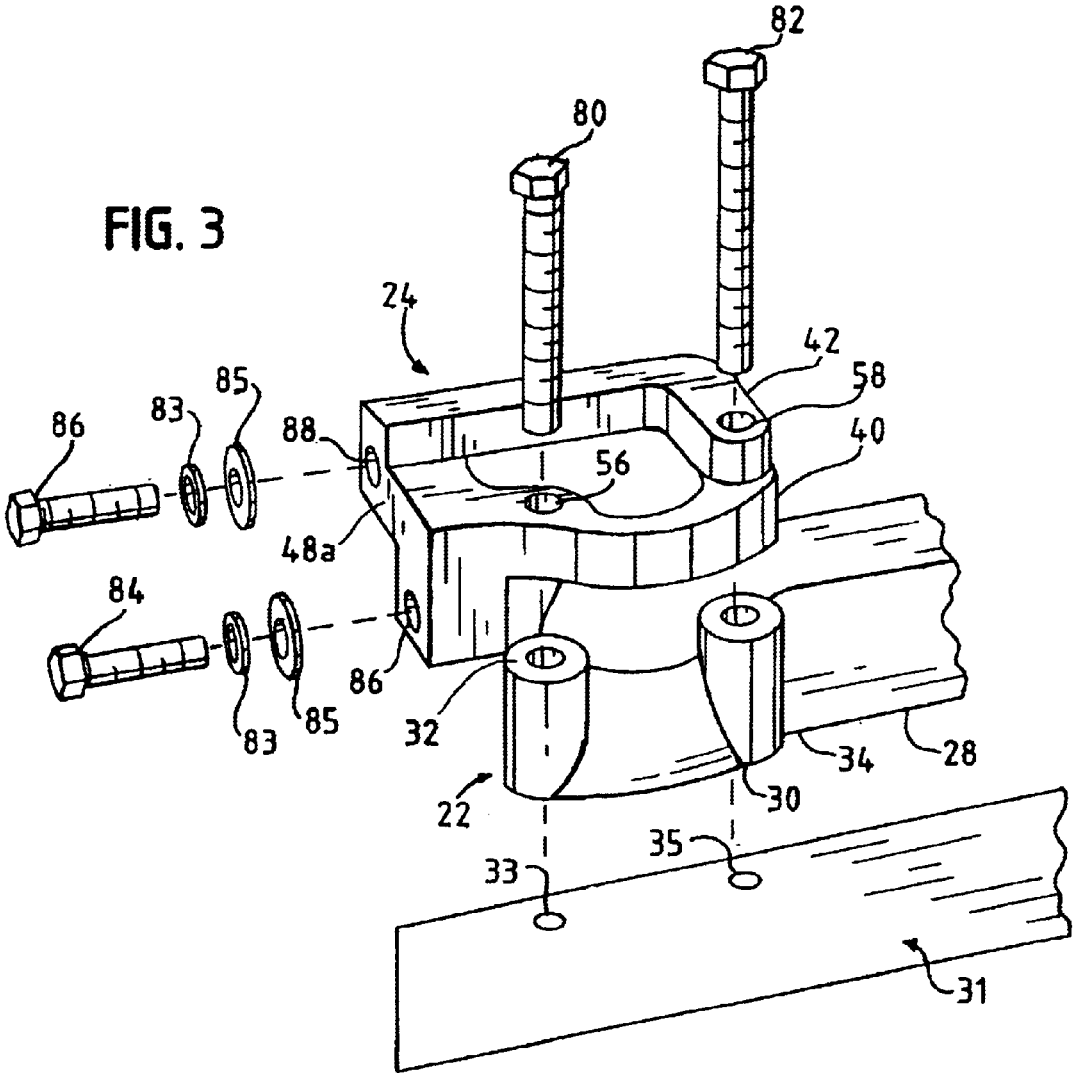
FIG. 3 is an exploded perspective view of Applicant's new manifold with an alternate embodiment adaptor for connecting an accessory such as an alternator to the engine cylinder head.

In an alternate embodiment, the adaptor 24 is modified to receive the attachment of the accessory along the side 48*a* of the adaptor 24 as illustrated in FIG. 3. In this embodiment, side 48*a* of the base 40 is extended outwardly to provide a flat surface to receive an abutting accessory. The side 48*a* has side receiving holes 86 and 88. In the preferred embodiment, the side receiving holes 86 and 88 are threaded.

In use, the adaptor 24 and the engine manifold 22 are secured to the engine cylinder head in the same manner as described in detail above with the first embodiment. Upon attachment of the accessory to the side 48*a*, threaded screws 84 and 86 are inserted completely through corresponding holes in the accessory (not illustrated) or a mounting bracket attached to the accessory and then directly into the side receiving holes 86 and 88, respectively, of the adaptor 24. As the side receiving holes 86 and 88 are likewise threaded, the screws 84 and 86 are turned and frictionally received by the side receiving holes 86 and 88, thereby, securing the accessory to the adaptor 24. Local washers 83 and fender washers may also be used along with the screws 84 and 86 in securing the accessory to the adaptor 24.

If, however, an auxiliary device is not being mounted to the manifold 22, then the adaptor 24 is not necessary to secure the auxiliary device to the engine cylinder head 31. In this example, the manifold 22 continues to replace the preexisting manifolds and exists independently of the adaptor 24.

Thus, there has been provided a new engine manifold and adaptor that replaces two preexisting manifolds thereby reducing inventory and tooling. It also provides a unique adaptor to accommodate the mounting of auxiliary devices such as an alternator or generator to the manifold and engine cylinder head. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. An adaptor for use in connecting an engine accessory to a manifold which is attached to an engine cylinder head, comprising:

a rigid member having a top surface, a bottom surface, and a side surface;

at least one threaded receiving hole in the top surface of the rigid member;

at least one smooth bore securing hole in the rigid member extending from the top surface to the bottom surface;

a bracket having a top side and a bottom side;

a first fastening means for attaching the engine accessory to the top side of the bracket:

a second fastening means for attaching the bottom side of the bracket to the top surface of the rigid member, the second fastening means being received into the at least one threaded receiving hole in the rigid member;

a securing means for securing the bottom surface of the rigid member to the manifold by passing the securing means through the at least one securing hole and receiving the securing means in the engine cylinder head.

2. The adaptor of claim 1 wherein the rigid member is made of cast iron material.

3. The adaptor of claim 1 wherein the second fastening means for attaching the accessory bracket to the at least one threaded receiving hole in the rigid member is a threaded screw.

4. The adaptor of claim 1 wherein the securing means for securing the adaptor to the manifold using the at least one securing hole is a threaded screw.

5. The adaptor of claim 1 wherein the rigid member has an opening centrally located within the rigid member with the at least one receiving hole and the at least one securing hole positioned on opposite sides of the opening.

6. The adaptor of claim 5 wherein the opening has an arc situated adjacent to the at least one securing hole which engages a portion of the manifold for restricting rotation of the rigid member when it is secured to the manifold.

7. An adaptor for use in connecting an engine accessory to a manifold which is attached to an engine cylinder head, comprising:

a rigid member having a top surface, a bottom surface, and a side surface;

a plurality of threaded receiving holes in the top surface of the rigid member;

a plurality of smooth bore securing holes in the rigid member extending from the top surface to the bottom surface;

a bracket having a top side, a bottom side, and further defining a plurality of mounting holes extending from the top side to the bottom side;

a fastening means for attaching the engine accessory to the top side of the bracket;

a plurality of screws correspondingly aligned and received into each of the plurality of mounting holes and the plurality of threaded receiving holes for attaching the bottom side of the bracket to the top surface of the rigid member and correspondingly aligned and passed through each of the plurality of securing holes for securing the bottom surface of the rigid member to the manifold;

whereby, upon assembly, the rigid member is positioned between the accessory and the manifold and thereby securing the accessory to the manifold.

8. The adaptor of claim 7 wherein the rigid member is made of cast iron material.

9. The adaptor of claim 7 wherein the rigid member has an opening centrally located within the rigid member with the at plurality of threaded receiving holes and the plurality of smooth bore securing holes positioned on opposite sides of the opening.

10. The adaptor of claim 9 wherein the opening has an arc situated adjacent to the plurality of securing holes which engages a portion of the manifold for restricting rotation of the rigid member when it is secured to the manifold.

11. An adaptor and a manifold used in combination for securing an engine accessory to an engine cylinder head, comprising:

a rigid member having a top surface, a bottom surface, and a side surface;

a plurality of threaded receiving holes located in the top surface of the rigid member;

a plurality of smooth bore securing holes in the rigid member extending from the top surface to the bottom surface;

the manifold having a body defining a first end, a second end, a top surface, and a bottom surface;

a plurality of smooth bore manifold mounting holes in the first end of the manifold extending from the top surface of the manifold to the bottom surface of the manifold;

fastening means for attaching the engine accessory to the top surface of the rigid member, the fastening means being received into the plurality of receiving holes in the rigid member;

a securing means for securing the bottom surface of the rigid member to the top surface of the manifold and the bottom surface of the manifold to the engine cylinder head, the securing means being inserted through the plurality of securing holes, through the plurality of smooth bore manifold mounting holes correspondingly aligned in parallel with the plurality of securing holes, and receiving the securing means in the engine cylinder head;

alternate securing means for securing the manifold to the engine cylinder head when the rigid member is not utilized, the alternate securing means being inserted through the plurality of smooth bore manifold mounting holes and receiving the alternate securing means in the engine cylinder head.

12. The adaptor and manifold of claim 11 wherein the fastening means for attaching the engine accessory to the rigid member is a screw.

13. The adaptor and manifold of claim 11 wherein the securing means for securing the rigid member to the manifold is a screw.

14. An adaptor and a manifold used in combination for securing an engine accessory to an engine cylinder head, comprising:

a rigid member having a top surface, a bottom surface, and a side surface;

a plurality of threaded receiving holes located in the top surface of the rigid member;

a plurality of smooth bore securing holes in the rigid member extending from the top surface to the bottom surface;

a bracket having a top side and a bottom side;

a first fastening means for attaching the engine accessory to the top side of the bracket;

the manifold having a body defining a first end, a second end, a top surface, and a bottom surface;

a plurality of smooth bore manifold mounting holes in the first end of the manifold extending from the top surface of the manifold to the bottom surface of the manifold;

a second fastening means for attaching the bottom side of the bracket to the top surface of the rigid member, the second fastening means being received into the plurality of receiving holes in the rigid member;

a securing means for securing the bottom surface of the rigid member to the top surface of the manifold and the bottom surface of the manifold to the engine cylinder head, the securing means being inserted through the plurality of securing holes, through the plurality of smooth bore manifold mounting holes correspondingly aligned in parallel with the plurality of securing holes, and receiving the securing means in the engine cylinder head;

alternate securing means for securing the manifold to the engine cylinder head when the rigid member is not utilized, the alternate securing means being inserted through the plurality of smooth bore manifold mounting holes and receiving the alternate securing means in the engine cylinder head.

* * * * *

UNITED STATES PATENT AND TRADEMARK OFFICE

CERTIFICATE OF CORRECTION

PATENT NO. : 6,832,591 B2
DATED : December 21, 2004
INVENTOR(S) : Jon Hogins

It is certified that error appears in the above-identified patent and that said Letters Patent is hereby corrected as shown below:

Column 6,
Line 4, please delete "accessory."

Signed and Sealed this

First Day of March, 2005

JON W. DUDAS
*Director of the United States Patent and Trademark Office*